US011346367B2

(12) United States Patent
Yu et al.

(10) Patent No.: US 11,346,367 B2
(45) Date of Patent: May 31, 2022

(54) COMPRESSOR ROTOR CASING WITH SWEPT GROOVES

(71) Applicant: PRATT & WHITNEY CANADA CORP., Longueuil (CA)

(72) Inventors: Hong Yu, Oakville (CA); Feng Shi, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 237 days.

(21) Appl. No.: 16/525,839

(22) Filed: Jul. 30, 2019

(65) Prior Publication Data

US 2021/0033108 A1 Feb. 4, 2021

(51) Int. Cl.
*F04D 29/52* (2006.01)
*F04D 29/68* (2006.01)

(52) U.S. Cl.
CPC ..... *F04D 29/526* (2013.01); *F04D 29/681* (2013.01)

(58) Field of Classification Search
CPC .... F04D 29/526; F04D 29/681; F04D 29/685; F01D 11/08
See application file for complete search history.

(56) References Cited

U.S. PATENT DOCUMENTS

| | | | | |
|---|---|---|---|---|
| 4,466,772 | A | 8/1984 | Okapuu et al. | |
| 5,707,206 | A | 1/1998 | Goto et al. | |
| 6,499,940 | B2 | 12/2002 | Adams | |
| 6,619,909 | B2 * | 9/2003 | Barnett | F04D 29/4206 415/57.4 |
| 8,337,146 | B2 * | 12/2012 | Yu | F01D 11/122 415/119 |
| 8,550,768 | B2 * | 10/2013 | Montgomery | F04D 29/526 415/1 |
| 10,066,640 | B2 * | 9/2018 | Bennington | F04D 29/526 |
| 10,309,243 | B2 * | 6/2019 | McCaffrey | F01D 9/02 |
| 2016/0153465 | A1 | 6/2016 | Yoon et al. | |
| 2020/0386111 | A1 * | 12/2020 | Reynolds | F04D 29/526 |

* cited by examiner

*Primary Examiner* — Sabbir Hasan
(74) *Attorney, Agent, or Firm* — Norton Rose Fulbright Canada LLP

(57) ABSTRACT

The compressor for a gas turbine engine includes a rotor with blades, and a shroud surrounding the rotor and having an inner surface surrounding tips of the blade. A plurality of grooves are defined in the inner surface of the shroud adjacent the blade tips, the grooves extending circumferentially about the shroud and extending radially from groove inlet openings defined in the inner surface to closed end surfaces of the grooves. The grooves are axially spaced-apart from each other and disposed axially between the leading and trailing edges of the blades. The grooves have a forwardly swept angle from the inner surface, and circumferential interruptions such that the grooves extend non-continuously around the shroud circumference.

21 Claims, 3 Drawing Sheets

COMPRESSOR ROTOR CASING WITH SWEPT GROOVES

TECHNICAL FIELD

The application relates generally to gas turbine engines and, more particularly, to compressors for such engines.

BACKGROUND OF THE ART

Compressor stall margin is one of many aspects that may affect the overall performance of the gas turbine engines. While compressor shrouds or casings may have various configurations in order to enhance rotor stall margin, such as surface treatment and/or structural modifications provided on the surface of the shroud, minimizing performance loss in this regard remains desirable.

SUMMARY

In one aspect, there is provided a compressor for a gas turbine engine, comprising: a rotor having a plurality of blades mounted for rotation about a central axis, the blades having blade tips extending between leading and trailing edges, and a shroud surrounding the rotor and having an inner surface surrounding the blade tips, a plurality of grooves defined in said inner surface of the shroud adjacent said blade tips, the grooves extending circumferentially about the shroud and extending radially from groove inlet openings defined in the inner surface to closed end surfaces of the grooves, the grooves being axially spaced-apart from each other and disposed axially between the leading and trailing edges of the blades, the grooves having a forwardly swept angle from the inner surface such that a center of the groove inlet opening is located axially rearward of a center of the closed-end surface of each of the grooves, wherein the grooves have circumferential interruptions such that the grooves extend non-continuously around a shroud circumference.

In another aspect, there is provided a shroud treatment embedded in a layer of abradable material of an inner surface of a compressor shroud, comprising: a plurality of grooves defined in the inner surface of the compressor shroud, the grooves extending circumferentially about the compressor shroud and has sidewalls extending radially and forwardly from groove inlet openings defined in the inner surface to closed-end surfaces, such that the plurality of grooves are forwardly swept, and wherein the grooves are circumferentially interrupted so as to be non-continuous around the compressor shroud.

In a further aspect, there is provided a method of manufacturing a gas turbine engine compressor, the compressor having a shroud, the method comprising: lining part of an inner surface of the shroud with a layer of abradable material along at least part of a circumference of the shroud, forming a plurality of grooves in the layer of abradable material, the grooves extending circumferentially along the shroud and extending radially from groove inlet openings defined in the inner surface to closed-end surfaces, the grooves being axially spaced-apart from each other, each groove having a forwardly swept angle θ, the angle θ taken between an axis normal to the inner surface of the shroud and a central axis GA extending longitudinally through a center of the grooves, and forming a plurality of baffles inside each one of the grooves, the baffles circumferentially spaced-apart within the grooves and projecting from the closed-end surfaces to the inlet openings, the plurality of baffles circumferentially interrupting the grooves to define separate groove segments.

BRIEF DESCRIPTION OF THE DRAWINGS

Reference is now made to the accompanying figures in which.

DETAILED DESCRIPTION

Figure 1:
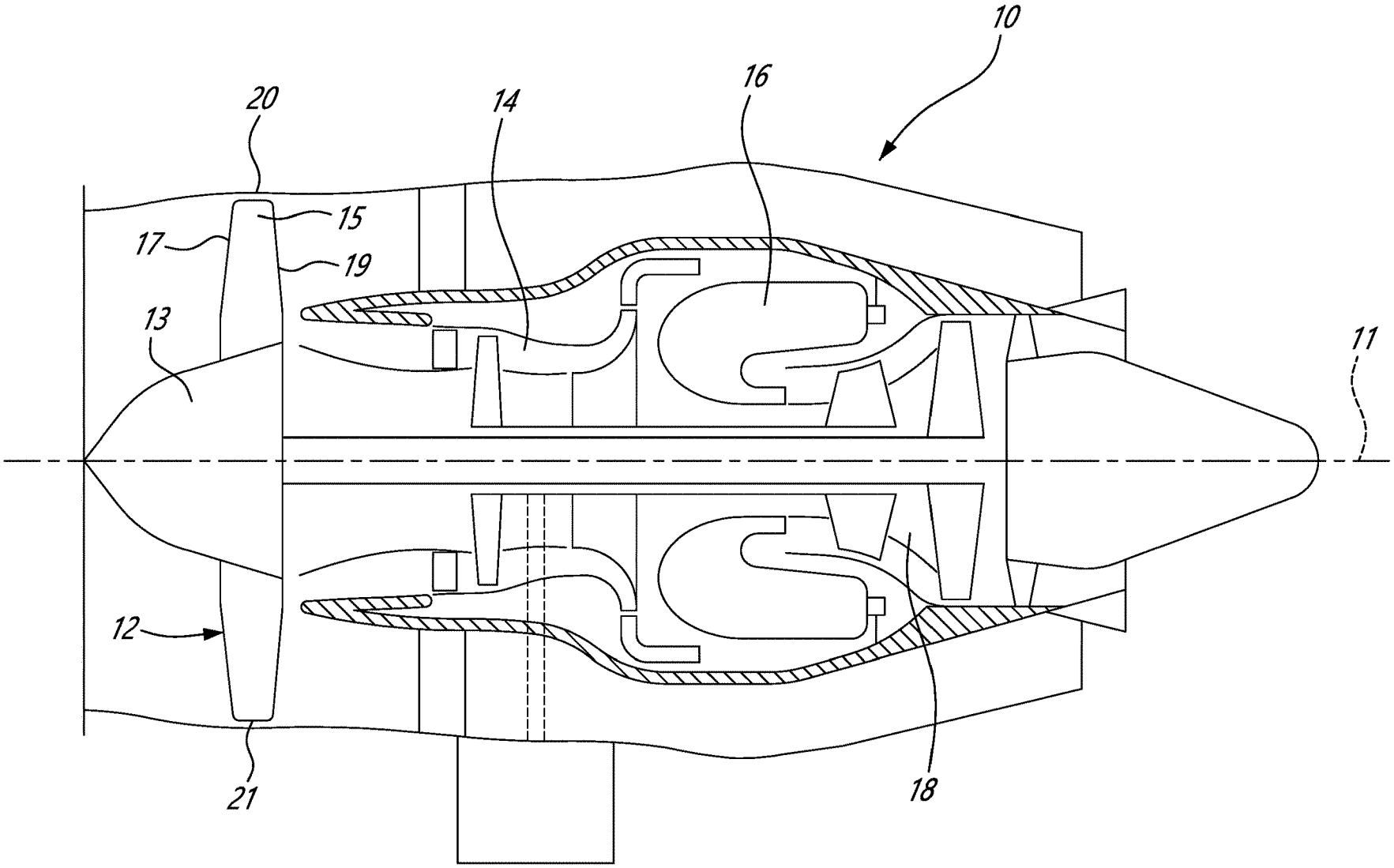
FIG. 1 is a schematic cross-sectional view of a gas turbine engine.

FIG. 1 illustrates a turbofan gas turbine engine 10 of a type preferably provided for use in subsonic flight, generally comprising in serial flow communication a transonic fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
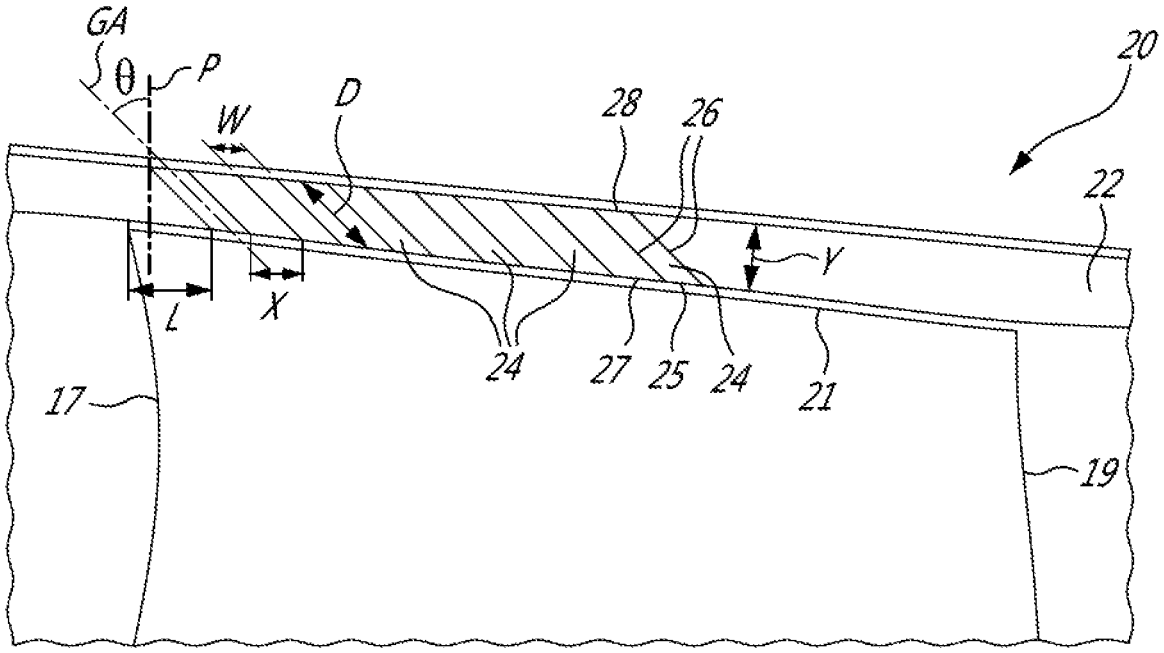
FIG. 2 is a schematic cross-sectional view of an exemplary part of the compressor rotor casing of the engine shown in FIG. 1.

The fan 12, also referred to as a low compressor, comprises a rotor 13 mounted for rotation about the engine central axis 11. The rotor 13 is provided with a plurality of radially extending blades 15. Each blade 15 has a leading edge 17 and a trailing edge 19 extending radially outwardly from the rotor hub to a tip 21. The rotor 13 is surrounded by a casing 20 including a stationary annular shroud disposed adjacent the tips 21 of the blades 15 and defining an outer boundary for the main flow path. As shown in FIG. 2, the casing inner surface is lined with a layer of abradable material 22. The layer of abradable material 22 may thus be considered as part of the casing inner surface. Abradable material is a material that may detach or break from the casing 20 without causing damages, i.e. none or no damage that would impact the integrity of the tips 21 of the blades 15 if interference occurs. The radial distance or gap between the tip 21 of the blades 15 and the adjacent inner surface of the casing 20 is defined as the rotor tip clearance. Each rotor is designed with a nominal rotor tip clearance to prevent or limit interference between the tip 21 of the blades 15 and the casing 20, which may occur due to rotor imbalance.

Referring to FIG. 2, it can be seen that a surface treatment is applied to the low pressure compressor or fan casing 20, though such surface treatment may be applied to a high pressure compressor. As will be seen hereinafter, the surface treatment allows stall margin to be increased and/or tip clearance vortex flow to be weakened and may help to direct the vortex flow in the main flow stream direction. The rotor casing treatment comprises a series of regularly axially spaced-apart circumferential grooves 24 defined in the abradable region of the casing inner surface (region of the casing 20 having the layer of abradable material 22) axially aligned with the tips 21 of the blades 15. Having regularly axially spaced-apart grooves 24, as opposed to irregularly spaced-apart grooves may facilitate manufacturing and/or parametric design of the engine 10 and/or the surface treatment.

Figure 3:
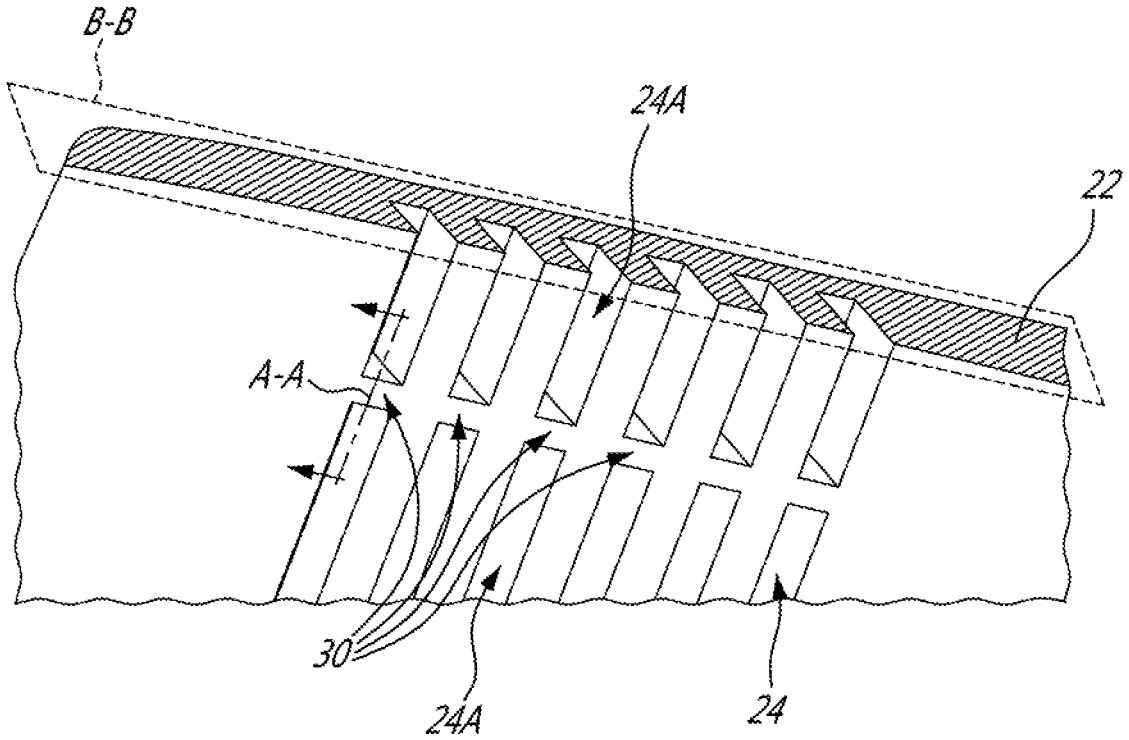
FIG. 3 is an enlarged perspective view of an exemplary part of the compressor rotor casing of FIGS. 1-2, defining a cross-section A-A and a cross-section B-B.

As shown in FIG. 3, the grooves 24 do not extend continuously around 360 degrees. Stated differently, each groove 24 is intersected or interrupted over the circumference of the casing 20. In other words, the grooves 24 have circumferential interruptions such that the grooves 24 extend non-continuously around a shroud circumference. In the depicted embodiment, the circumferential interruptions are defined by a plurality of baffles 30. In other words, each groove 24 comprises a plurality of segments 24A extending circumferentially and separated from an adjacent one of the segments 24A by one of the baffles 30. Although not "continuous" along the full circumference of the casing inner surface, each interrupted groove will be referred to as one groove 24 that comprises a plurality of groove segments 24A, for simplicity.

In the illustrated example, six shallow circumferentially extending grooves 24 are embedded in the abradable layer 22 of the rotor shroud around the blades 15. However, it is understood that the series of grooves 24 could be composed of more or less than six grooves 24. For instance, the rotor casing treatment could comprise from 2 to 15 grooves depending on the rotor configuration. In a particular embodiment, the rotor casing treatment has only one groove 24 (i.e. a single circumferential groove 24). The grooves 24 may also be irregularly axially spaced-apart in other embodiments.

Returning to FIG. 2, the grooves 24 are axially located between the leading edge 17 and the trailing edge 19 of the blades 15. According to one example, the opening 25 of the first or upstream groove 24 is located downstream of the blade leading edge 17 and spaced therefrom by a distance L corresponding to approximately 0% to 30% of the chord length of the blades 15. In the depicted embodiment, the last or downstream groove 24 is positioned upstream of the blade trailing edges 19. Having the distance L within this range may optimize their effect on the flow vortex, which may not be the case with higher proportions.

In the depicted embodiment, each groove 24 is defined by a pair of axially opposed sidewalls 26, in this embodiment substantially flat, extending forwardly (i.e. towards the front of the engine) from the groove opening (or groove inlet) 25 defined in the shroud surface 27 to a closed-end surface 28. The closed-end surface 28 may be flat, rounded or semi-circular in various embodiments. In the depicted embodiment, opposed sidewalls 26 of adjacent grooves 24 intersect at the opening (or "inlet") 25 with the shroud surface 27, corresponding to a portion of the casing inner surface between adjacent grooves 24, forming a sharp edge. Such edge may be rounded up in other embodiments.

As shown in FIG. 2, each groove 24 has a depth D and a width W. The grooves 24 are spaced apart from one another by a spacing X taken axially along the shroud inner surface 27 (distance between the opening of adjacent grooves 24). Each groove 24 has a depth projection Y normal to the casing inner surface.

The grooves 24 are forwardly swept (i.e. swept towards a front of the engine, which may also be upstream relative to the main gas flow through the compressor rotor) at an angle θ. In other words, when viewed axially along the tip 21 of a blade 15 from its leading edge 17 to its trailing edge 19, such as in FIGS. 2 and 4, the closed-end surface 28 of each of the grooves 24 is located upstream of the opening 25 of the corresponding groove 24. Alternately defined, the grooves 24 are inclined such that a center of their inlet openings 25 is located axially rearward of a center of their closed-end surfaces 28 with respect to the orientation of the grooves 24 of the casing 20 in the engine 10. The angle θ is taken between an axis P normal to the casing inner surface 27 and a central axis GA extending longitudinally through a center of the grooves 24. Angle θ may be referred to as the groove swept angle, or groove sweep angle, and is more than 0° and less than 75°. In an embodiment, the angle θ is at least 10° but no more than 75°. Due to the groove swept angle within this range, the swept angled grooves 24 may contribute to minimizing total pressure loss by having the flow exiting from the grooves 24 with a sufficient main flow stream direction component, and/or may allow maximizing an internal volume of the grooves 24 although the layer of abradable material 22 of the rotor casing may be thin, for maximizing compactness of the rotor casing 20 (to reduce weight and/or size of the rotor casing 20). In the depicted embodiment, the grooves are all angled identically, but one or more of the grooves 24 may have a different angle θ than other ones or more of the grooves 24 in other embodiments.

In one embodiment, the width W of the grooves 24 is between about 1% to about 15% of the chord length of the blades 15. The spacing X may have any suitable value, so long as the aspect ratio X/W is from about 0.1 to about 5. If the aspect ratio was too large, for instance greater or much greater than 5, the originations of tip vortex may not be captured, which would be less desirable (less desirable or not desirable at all). In one particular embodiment, the ratio Y/W ranges from about 0.5 to 10. In most cases, larger ratios may be better to trap the tip vortex, though manufacturing may limit the possibilities to have a greater ratio (e.g. a ratio greater or much greater than 10).

While in some embodiments the grooves 24 may all have a same geometry, one or more of the grooves may have a respective geometry that may differ in one or more dimensions, in some cases.

Figure 4:
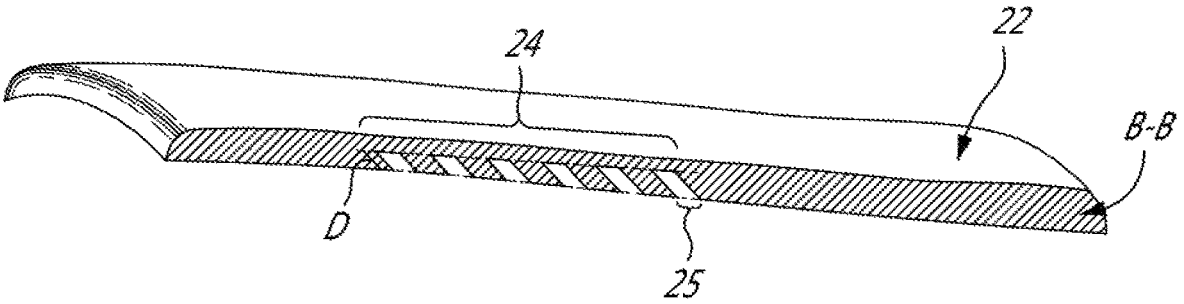
FIG. 4 is another perspective view of the exemplary part of FIG. 3, showing the cross-section B-B in a different angle.

As shown in FIGS. 2 and 4, the respective depths D of the grooves 24 vary from the first (most upstream groove 24) to the last, more particularly, in this case the respective depths D of the grooves 24 increase from the first to the last groove 24, although they may all have an equal depth D in other embodiments. Depending on the embodiments, the respective depths D of the grooves 24 may substantially correspond to the thickness of the layer of abradable material 22 at the local areas where they are defined. Stated differently, the depth projection Y of the grooves 24 may substantially correspond to the thickness of the abradable material 22.

Now referring to FIG. 3, the arrays of baffles 30 in the grooves 24 may be angularly aligned with respect to each other. However, the baffles 30 could as well be angularly staggered in the different grooves 24. Also the number of baffles in the grooves 24 does not have to be the same. In an embodiment, the number of baffles 30 in each groove 24 is greater than the number of rotor blades 15 but less than 5 times of the latter. In a particular embodiment, the number of baffles 30 in each groove 24 is between 2 and 5 times the number of rotor blades 15. In another particular embodiment, there are two times more baffles 30 per groove 24 than rotor blades 15. Having a greater number of baffles 30 per groove 24 may impede the effects of the casing treatment.

Figure 3A:
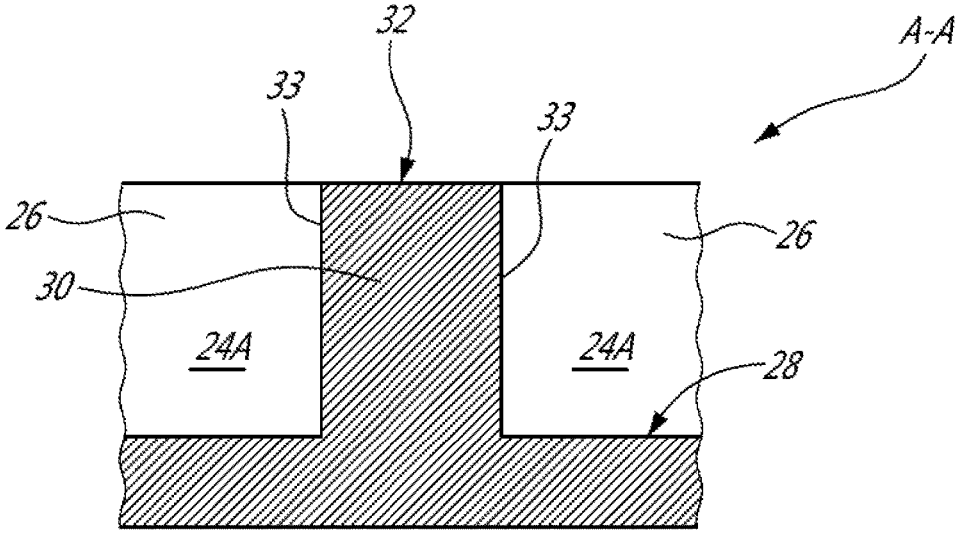
FIG. 3A is a schematic cross-sectional view taken through A-A in FIG. 3.

As shown in FIG. 3A, the baffles 30 are provided in the form of projections from the closed-end surface 28 of the grooves 24 to the inlet opening 25 thereof. That is, the baffles 30 protrude from the closed-end surface 28 over a distance corresponding to the full depth D of the groove 24 in which the baffles 30 are located. The baffles 30 do not necessarily have to be the same shape. The baffles 30 may be integrally machined, moulded or otherwise formed on the closed-end surface 28 of the grooves 24. For instance, cutting tools, such as conventional wood ruff cutters, could be used for machining the grooves 24 and the baffles 30 in the abradable layer 22. In this way, the baffles 30 can be formed in the grooves 24 in a cost effective manner. The reparability of the casing 20 may be good since the grooves 24 and the baffles 30 are machined in abradable material.

The baffles 30 extend the full width W of the grooves 24 between the groove sidewalls 26 (see FIG. 3). As shown in FIG. 3, each baffle 30 has a substantially flat surface 32 extending in the same plane as the shroud inner surface 27. In other words, the flat surface 32 of the baffles 30 form a continuous surface with adjacent portions of the shroud inner surface. Forming such continuous surface with adjacent portions of the shroud inner surface may contribute to optimizing the effects of the casing treatment herein described. The flat surface 32 may have other shape, such as concave or other non-flat shape in other embodiments.

As shown in FIG. 3A, the baffles 30 extends along the full depth D of the grooves 24. This may maximize the break of the swirl component (circumferential component) of the main flow stream at the tip of the blades 15 (or simply tip vortex). In the depicted embodiment, the baffles 30 have two opposed walls 33 spaced apart circumferentially from each other and defining respective ends of the baffles 30 (i.e. ends that are spaced apart in the circumferential direction of the grooves 24). In the depicted embodiment, the two opposed walls 33 merge with the flat surface 32 to form a sharp edge at their junction, though rounded edges may be contemplated in other embodiments. The grooves closed-end surface 28 and the baffles 30 form an intersected radially inwardly facing surface at the closed end of each groove 24, such that the radially inwardly facing surface is discontinuous along the length (defined along the circumference of the casing inner surface) of each groove 24. Although such circumferentially intersected grooves 24 may generate flow turbulence due to the baffles 30 opposing the circumferential component of the tip flow vortex entering and exiting the grooves 24, such turbulence resulting from the presence of the baffles 30 may be more beneficial to the performance of the engine 10 than if the baffles 30 were omitted entirely, where the circumferential component of the main flow stream (or tip vortex), would not be suitably controlled. The presence of groove interruptions, such as the baffles 30 herein described, may enhance the momentum exchanges between main flow and tip clearance flow, hence enhance the effect of the casing treatment.

The above description is meant to be exemplary only, and one skilled in the art will recognize that changes may be made to the embodiments described without departing from the scope of the invention disclosed. While the rotor casing treatment has been described in connection with a fan casing, it is understood that the surface treatment could be applied to other type rotor casing. For instance, it could be applied in any suitable gas turbine fans, low/high pressure compressor sections of turbine engines, axial compressor rotors, mixed flow compressor rotors and compressor impellers. Still other modifications which fall within the scope of the present invention will be apparent to those skilled in the art, in light of a review of this disclosure, and such modifications are intended to fall within the appended claims.

The invention claimed is:

1. A compressor for a gas turbine engine, comprising:

a rotor having a plurality of blades mounted for rotation about a central axis, the plurality of blades having blade tips extending between leading and trailing edges, and a shroud surrounding the rotor and having an inner surface surrounding the blade tips, a plurality of grooves defined in said inner surface of the shroud adjacent said blade tips, the plurality of grooves extending circumferentially about the shroud and extending radially from groove inlet openings defined in the inner surface to closed end surfaces of the plurality of grooves, the plurality of grooves having sidewalls extending circumferentially about the central axis, the plurality of grooves being axially spaced-apart from each other, the plurality of grooves having a forwardly swept angle θ from the inner surface such that a center of the groove inlet openings is located axially rearward of a center of the closed-end surface of each of the plurality of grooves, wherein the plurality of grooves have circumferential interruptions such that the plurality of grooves extend non-continuously around a shroud circumference, wherein the circumferential interruptions of the plurality of grooves are defined by a plurality of baffles, the plurality of baffles being circumferentially spaced apart and projecting from the closed end surfaces to the groove inlet openings.

2. The compressor as defined in claim 1, wherein the groove inlet opening of the most upstream one of the plurality of grooves is located downstream of the leading edges of the plurality of blades and axially spaced therefrom by a distance corresponding to 0% to 30% of a chord length of the plurality of blades.

3. The compressor as defined in claim 1, wherein the plurality of grooves have a width between 1% and 15% of a chord length of the plurality of blades.

4. The compressor as defined in claim 1, wherein each groove of the plurality of grooves has a respective depth D, the depths D of the plurality of grooves increasing from the most upstream one of the plurality of grooves to the most downstream one of the plurality of grooves.

5. The compressor as defined in claim 1, wherein the forwardly swept angle θ of the plurality of grooves is at least 10° but no more than 75°.

6. The compressor as defined in claim 1, wherein the plurality of baffles have a number of baffles per groove greater than 2 times but less than 5 times the number of blades of the plurality of blades.

7. The compressor as defined in claim 1, wherein the plurality of baffles have a number of baffles per groove corresponding to more than the number of blades of the plurality of blades but less than 5 times the number of blades of the plurality of blades.

8. The compressor as defined in claim 1, wherein the plurality of baffles have a number of baffles per groove corresponding to two times the number of blades of the plurality of blades.

9. The compressor as defined in claim 1, wherein the compressor includes a layer of abradable material lined on the inner surface of the shroud about the blade tips, the layer of abradable material embedding the plurality of grooves and the plurality of baffles.

10. The compressor as defined in claim 1, wherein the plurality of grooves have a depth projection Y normal to the inner surface of the shroud and the plurality of baffles have a width W, a ratio Y/W ranging from 0.5 to 10.

11. The compressor as defined in claim 1, wherein each one of the plurality of baffles have two opposed walls spaced apart circumferentially from each other and defining respective ends of the plurality of baffles, each one of the plurality of baffles having a flat surface, the two opposed walls merging with the flat surface.

12. A shroud treatment embedded in an inner surface of a compressor shroud, comprising:

a plurality of grooves defined in the inner surface of the compressor shroud, the plurality of grooves extending circumferentially about the compressor shroud, the plurality of grooves having sidewalls extending circumferentially about the compressor shroud, the sidewalls extending radially and forwardly from groove inlet openings defined in the inner surface to closed-end surfaces, such that the plurality of grooves are forwardly swept, and wherein the plurality of grooves are circumferentially interrupted by a plurality of baffles so as to be non-continuous around the compressor shroud, the plurality of baffles circumferentially spaced apart within the plurality of grooves and projecting from the closed end surfaces to the groove inlet openings to define separate groove segments.

13. The shroud treatment as defined in claim 12, wherein the sidewalls of the plurality of grooves extend radially and forwardly from the groove inlet openings such that the plurality of grooves have a forward swept angle θ away from the inner surface, the forward swept angle θ taken between an axis normal to the inner surface and a central axis GA extending longitudinally through a center of the plurality of grooves.

14. The shroud treatment as defined in claim 12, wherein the plurality of grooves have a forward swept angle θ of at least 10° but no more than 75°.

15. The shroud treatment as defined in claim 12, wherein the plurality of grooves include a first groove and a second groove adjacent to the first groove, the first groove and the second groove have a width W, the first groove and the second groove are axially spaced apart from each other by a spacing X such that a ratio X/W is from 0.1 to 5.

16. The shroud treatment as defined in claim 12, wherein the plurality of grooves have a depth projection Y normal to the inner surface of the compressor shroud and the plurality of baffles have a width W, a ratio Y/W ranging from 0.5 to 10.

17. The shroud treatment as defined in claim 12, wherein the plurality of grooves are circumferentially interrupted by the plurality of baffles having a number of baffles per groove corresponding to more than the number of blades of a plurality of blades but less than 5 times the number of blades of the plurality of blades.

18. The shroud treatment as defined in claim 12, wherein the compressor shroud includes a layer of abradable material lined on the inner surface of the compressor shroud about blade tips, the compressor shroud treatment embedded in the layer of abradable material.

19. The shroud treatment as defined in claim 12, wherein each one of the plurality of baffles have two opposed walls spaced apart circumferentially from each other and defining respective ends of the plurality of baffles, each one of the plurality of baffles having a flat surface, the two opposed walls merging with the flat surface.

20. The shroud treatment as defined in claim 12, wherein the plurality of grooves are irregularly axially spaced-apart from each other.

21. The shroud treatment as defined in claim 12, wherein the plurality of grooves have an equal depth.

* * * * *